US009689578B2

(12) United States Patent
Matsuura et al.

(10) Patent No.: US 9,689,578 B2
(45) Date of Patent: Jun. 27, 2017

(54) REFRIGERANT DISTRIBUTION UNIT FOR AIR CONDITIONER

(75) Inventors: Shun Matsuura, Kawasaki (JP); Haruki Yamashita, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 451 days.

(21) Appl. No.: 13/166,662

(22) Filed: Jun. 22, 2011

(65) Prior Publication Data

US 2012/0000553 A1 Jan. 5, 2012

(30) Foreign Application Priority Data

Jun. 30, 2010 (JP) ..... 2010-148522

(51) Int. Cl.
*F24F 1/34* (2011.01)
*F24F 1/32* (2011.01)
(Continued)

(52) U.S. Cl.
CPC ..... *F24F 1/32* (2013.01); *F24F 1/26* (2013.01); *F24F 1/34* (2013.01); *F25B 41/003* (2013.01); *Y10T 137/8376* (2015.04)

(58) Field of Classification Search
CPC ..... F24F 1/32; F24F 1/26; F24F 1/06
(Continued)

(56) References Cited

U.S. PATENT DOCUMENTS 4,385,504 A * 5/1983 Perrone ..... F25D 23/065 174/663
4,717,121 A * 1/1988 Hashimoto ..... F16C 1/105 251/228
(Continued)

FOREIGN PATENT DOCUMENTS

CN 101163925 A 4/2008
CN 201359411 Y 12/2009
(Continued)

OTHER PUBLICATIONS

Notification of Reasons for Refusal in Japanese Patent Application No. 2010-148522, dated Feb. 5, 2014.
(Continued)

*Primary Examiner* — Len Tran
*Assistant Examiner* — Alexis Cox
(74) *Attorney, Agent, or Firm* — Venable LLP; Michael A. Sartori; F. Brock Riggs

(57) ABSTRACT

A refrigerant distribution unit for an air conditioner, includes: a refrigerant pipe provided on an outdoor unit side; branch refrigerant pipes provided on an indoor unit side; a distribution portion which distributes a refrigerant from the refrigerant pipe to the branch refrigerant pipes; a main unit which stores the distribution portion and includes a first side face from which the refrigerant pipe is drawn out and a second side face from which the branch refrigerant pipes are drawn out; and an electric component box. Each of the branch refrigerant pipes includes a branch gas pipe and a branch liquid pipe which are drawn out from the second side face. The adjacent branch gas pipes are disposed parallel such that lengths of the branch gas pipes increase sequentially from one toward the other, and the adjacent branch liquid pipes are disposed parallel such that lengths of the branch liquid pipes similarly increase sequentially.

15 Claims, 12 Drawing Sheets

(51) Int. Cl.
*F24F 1/26* (2011.01)
*F25B 41/00* (2006.01)

(58) Field of Classification Search
USPC ..... 62/199, 236.2, 259.1
See application file for complete search history.

(56) References Cited

U.S. PATENT DOCUMENTS

| | | | | |
|---|---|---|---|---|
| 4,900,065 | A * | 2/1990 | Houck | 285/73 |
| 6,772,600 | B2 * | 8/2004 | Hwang | 62/160 |
| 7,757,722 | B1 * | 7/2010 | Lesch et al. | 138/149 |
| 8,104,303 | B2 * | 1/2012 | Murata et al. | 62/290 |
| 8,424,333 | B2 * | 4/2013 | Yoon | F24F 1/32 62/152 |
| 9,068,758 | B2 * | 6/2015 | Matsuura | F24F 1/26 |
| 9,353,957 | B2 * | 5/2016 | Matsuura | F24F 1/26 |
| 2007/0044496 | A1 * | 3/2007 | Ha | F24F 1/027 62/262 |
| 2009/0049855 | A1 * | 2/2009 | Murata et al. | 62/259.1 |
| 2012/0000227 | A1 * | 1/2012 | Matsuura et al. | 62/175 |
| 2012/0000231 | A1 * | 1/2012 | Lafontaine | 62/291 |
| 2013/0014525 | A1 * | 1/2013 | Koge et al. | 62/126 |

FOREIGN PATENT DOCUMENTS

| | | | |
|---|---|---|---|
| CN | 201368623 | Y | 12/2009 |
| EP | 0862023 | A2 | 9/1998 |
| GB | 2451722 | A | 2/2009 |
| JP | H06-137591 | A | 5/1994 |
| JP | H06-137592 | A | 5/1994 |
| JP | H10238899 | A | 9/1998 |
| JP | 2001241695 | A | 9/2001 |
| JP | 2001241697 | A | 9/2001 |
| JP | 2005-265377 | A | 9/2005 |
| JP | 2006-300381 | A | 11/2006 |

OTHER PUBLICATIONS

Notification of the First Office Action issued in Chinese Patent Application No. 201110183281.5 dated Jul. 30, 2014.

Extended European Search Report issued in European Patent Application No. 11171257.6 dated Jun. 9, 2015.

* cited by examiner

REFRIGERANT DISTRIBUTION UNIT FOR AIR CONDITIONER

This application claims priority from Japanese Patent Application No. 2010-148522, filed on Jun. 30, 2010, the entire contents of which are hereby incorporated by reference.

FIELD OF THE INVENTION

The present disclosure relates to a refrigerant distribution unit for an air conditioner which is used to distribute a refrigerant from an outdoor unit of the air conditioner to multiple indoor units thereof. Specifically, the present disclosure relates to enhanced efficiency of an installation operation of such refrigerant distribution unit.

DESCRIPTION OF RELATED ART

As a refrigerant distribution unit for distributing a refrigerant from an outdoor unit of an air conditioner to multiple indoor units thereof, for example, as disclosed in Japanese Patent Application Publication No. JP-A-2006-300381, there is known a refrigerant distribution unit which includes a refrigerant pipe provided on the outdoor unit, multiple branch refrigerant pipes respectively provided on the multiple indoor units, a distribution portion for distributing the refrigerant from the refrigerant pipe to the multiple branch refrigerant pipes, and a main unit for storing the distribution portion and also for drawing out the refrigerant pipe and branch refrigerant pipes from its respective opposed side surfaces.

The refrigerant pipe and branch refrigerant pipes are respectively constituted of a gas pipe and a liquid pipe; and, the gas pipe and the liquid pipe of each of the branch refrigerant pipes includes a indoor-unit-side partition in which a distance between the gas pipe and the liquid pipe increases in a vertical direction as the gas pipe and the liquid pipe away from the main unit toward the indoor unit. And, a rubber bush is provided between the indoor-unit-side partition and the distribution portion. The rubber bush surrounds the gas pipe and the liquid pipe in such a manner to unify the gas pipe and the liquid pipe.

Further, since the branch refrigerant pipes are arranged in a horizontal direction with respect to an installation direction of the refrigerant distribution unit, the branch refrigerant pipes are mounted such that the branch refrigerant pipes are flush with each other. Therefore, even when the refrigerant distribution unit is provided at a high site, an operator who maintains the refrigerant distribution unit is allowed to handle the refrigerant distribution unit easily. Also, in a step of installing the respective refrigerant distribution units, an operation for flare connection is easy to carry out.

According to JP-A-2006-300381, since the gas pipe and the liquid pipe of the branch refrigerant pipe which are adjacent with each other are equal in length to each other, when mounting the refrigerant distribution unit at a site in which no obstacle exists, the structure thereof is easy to operate. However, in the case that the installation site of such refrigerant distribution unit is limited, for example, when installing such refrigerant distribution unit on the near side of a wall, or when mounting the refrigerant distribution unit in such a manner that the branch refrigerant pipes are arranged in the vertical direction, the equal length of the adjoining gas pipe and liquid pipe makes it difficult to operate the gas pipe and liquid pipe situated on the deep side because the gap pipe and liquid pipe situated on the near side provide obstacles to them and thus a space for rotating a tool such as a spanner is limited.

SUMMARY OF INVENTION

Illustrative aspects of the present invention provide a refrigerant distribution unit which, even when the refrigerant distribution unit is mounted at a limited site, can facilitate an installation operation of the refrigerant pipes thereof.

According to a first aspect of the invention, a refrigerant distribution unit for an air conditioner, is provided with: a refrigerant pipe provided on a side of an outdoor unit; a plurality of branch refrigerant pipes respectively provided on sides of indoor units; a distribution portion which distributes a refrigerant from the refrigerant pipe to the plurality of branch refrigerant pipes; a main unit which stores the distribution portion and includes a first side face from which the refrigerant pipe is drawn out and a second side face from which the plurality of branch refrigerant pipes are drawn out, the second side face being opposed to the first side face; and an electric component box. Each of the plurality of branch refrigerant pipes includes a branch gas pipe having a first joint portion and a branch liquid pipe having a second joint portion on the indoor unit side. The branch gas pipes and the branch liquid pipes are drawn out from the second side face of the main unit in such a manner that the branch gas pipes and the branch liquid pipes are spaced a given distance from each other and are parallel to each other. The first and second joint portions are disposed in such a manner that the first and second joint portions are not overlapped with each other. The adjacent branch gas pipes are disposed parallel to each other in such a manner that lengths of the branch gas pipes increase sequentially from one toward the other. The adjacent branch liquid pipes are disposed parallel to each other in such a manner that lengths of the branch liquid pipes increase sequentially from one toward the other.

Other aspects and advantages of the invention will be apparent from the following description, the drawings and the claims.

BRIEF DESCRIPTION OF THE DRAWINGS

FIG. 10 shows a state of an electric component box included in the refrigerant distribution unit, in which the electric component box is mounted on a right side face of the refrigerant distribution unit when viewed from the outdoor unit side of the air conditioner, with a lower case removed from the electric component box. Specifically.

FIG. 11 shows a state of the electric component box included in the refrigerant distribution unit, in which the electric component box is mounted on a left side face of the refrigerant distribution unit when viewed from the outdoor unit side of the air conditioner, with a lower case removed from the electric component box. Specifically.

FIG. 12 shows a state of the refrigerant distribution unit in which the electric component box is disposed vertically. Specifically.

DETAILED DESCRIPTION OF EXEMPLARY EMBODIMENTS

Now, description will be given below specifically of the best mode for carrying out the invention, using the embodiments thereof with reference to the accompanying drawings.

Embodiment 1

<Air Conditioner>

Figure 1:
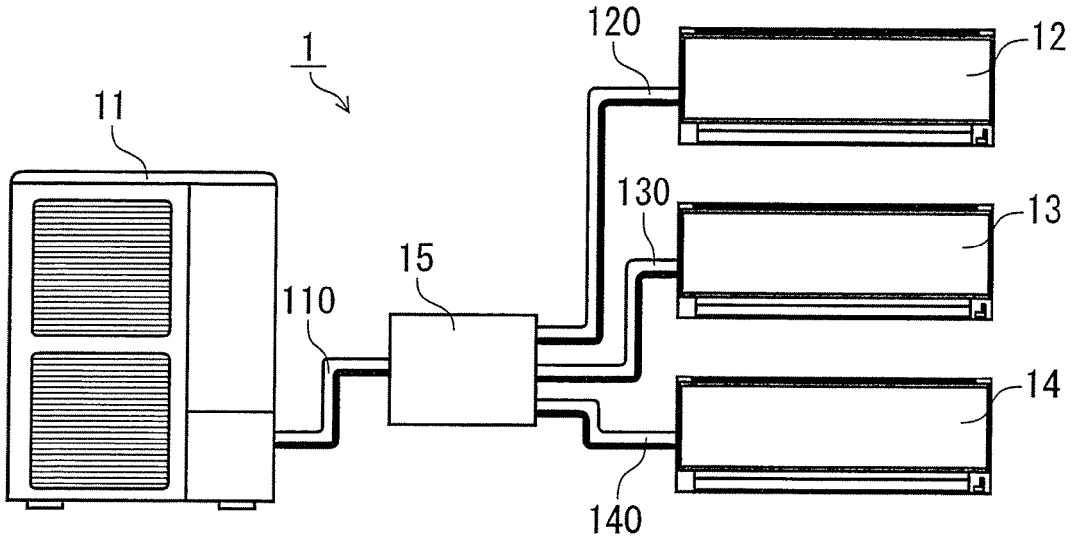
FIG. 1 is a schematic structure view showing an air conditioner according to an embodiment of the invention.

An air conditioner 1 shown in FIG. 1 includes an outdoor unit 11, and multiple indoor units 12, 13, 14.

The outdoor unit 11 includes the following composing parts (none of which are shown): that is, a portion of refrigerant circuits respectively for an outdoor heat exchanger, a compressor, a four way valve and the like; a fan for blasting air in order to exchange heat between a refrigerant within the outdoor heat exchanger and the open air; a fan motor for driving the fan; and, a control circuit for controlling the above composing parts.

The indoor units 12, 13 and 14 respectively include the following composing parts (none of which are shown): that is, a portion of refrigerant circuits respectively for an indoor heat exchanger and the like; a fan for blasting air in order to exchange heat between a refrigerant within the indoor heat exchanger and the open air; a fan motor for driving the fan; and, a control circuit for controlling the above composing parts.

The refrigerant circuit of the outdoor unit 11 is connected to the refrigerant circuits of the indoor units 12, 13 and 14 through an outdoor-unit-side pipe 110 and indoor-unit-side pipes 120, 130 and 140 respectively. Between the outdoor unit 11 and the multiple indoor units 12, 13 and 14, there is provided a refrigerant distribution unit 15 which is used to distribute a refrigerant uniformly from the outdoor-unit-side pipe 110 to the indoor-unit-side pipes 120, 130 and 140.

<Refrigerant Distribution Unit>

Figure 2:
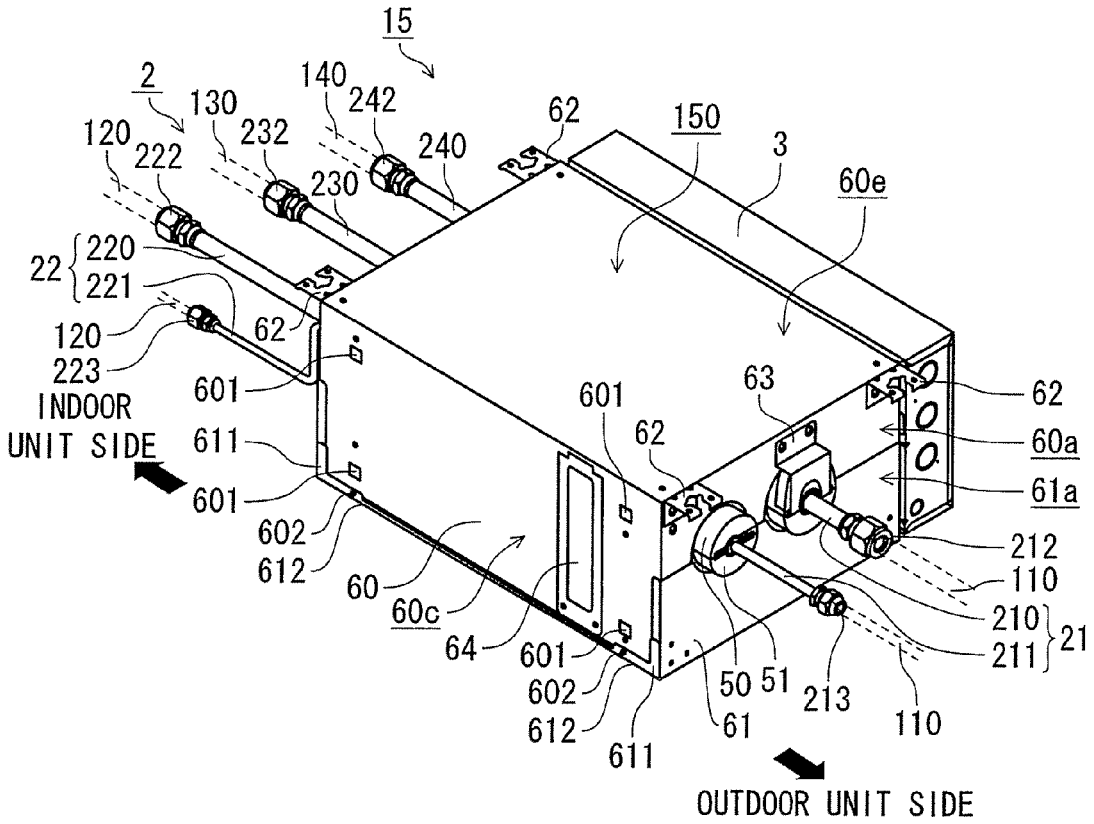
FIG. 2 is a perspective view showing a refrigerant distribution unit according to the embodiment.

The refrigerant distribution unit 15 shown in FIG. 2 includes: a pipe unit 2 for connecting the outdoor-unit-side pipe 110 to the respective indoor-unit-side pipes 120, 130 and 140 to distribute the refrigerant from the former to the latter; a main unit 150 for storing the pipe unit 2 therein; and, an electric component box 3 including a controller for controlling the electric parts that are mounted on the pipe unit 2.

The refrigerant distribution unit 15 is horizontally fixed to and hanged from an indoor attic or the like by multiple pieces of ceiling hanging metal fittings 62. And, in order to adjust to the environment of the attic which is liable to be hot and humid, especially, the inside of the main unit 150 has an insulating property which can prevent the inside against the influence of temperature variations and also the inside is sealed in order to prevent the inside against the influence of humidity.

Figure 3:
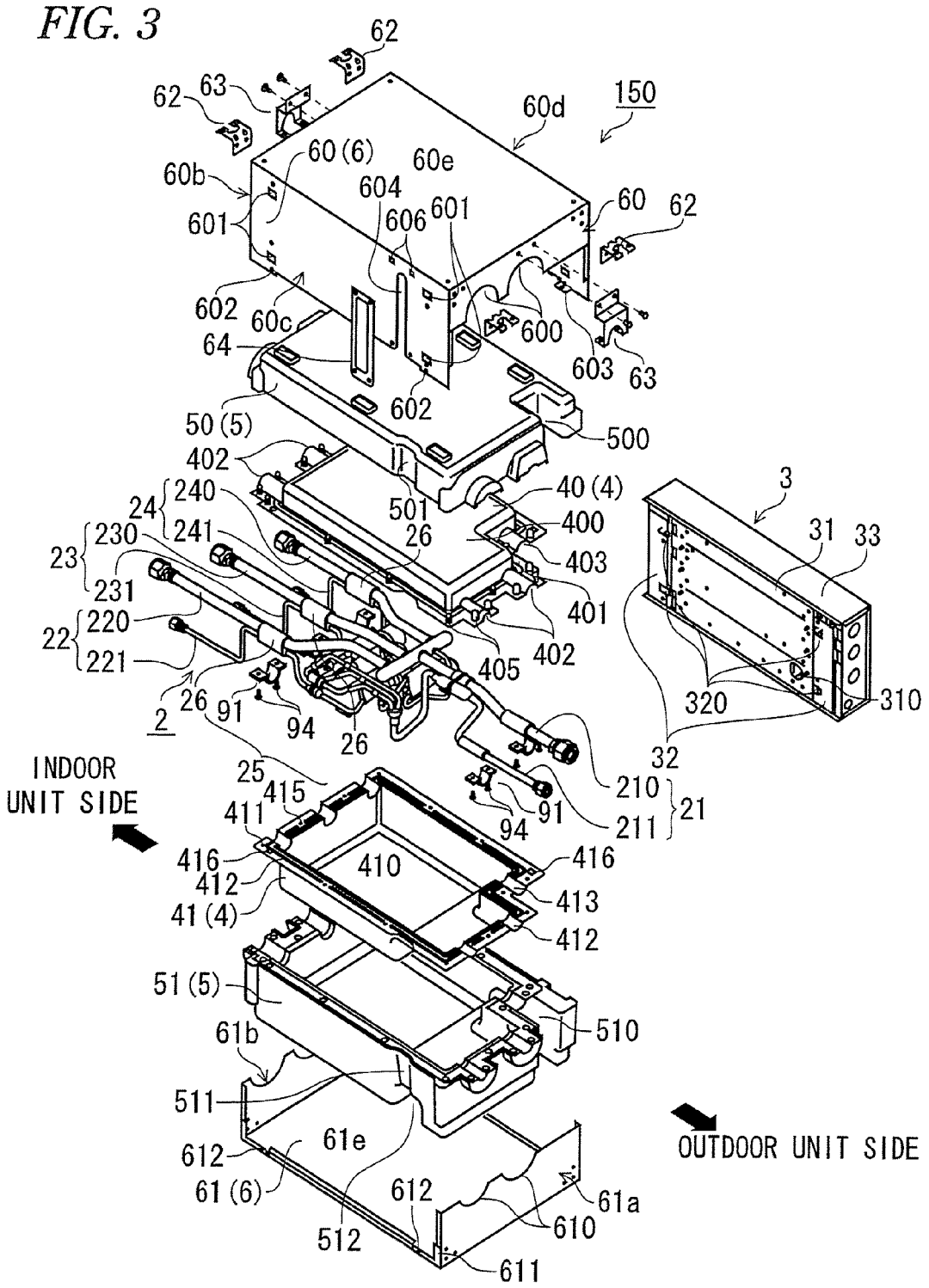
FIG. 3 is an exploded view showing the refrigerant distribution unit.
Figure 4:
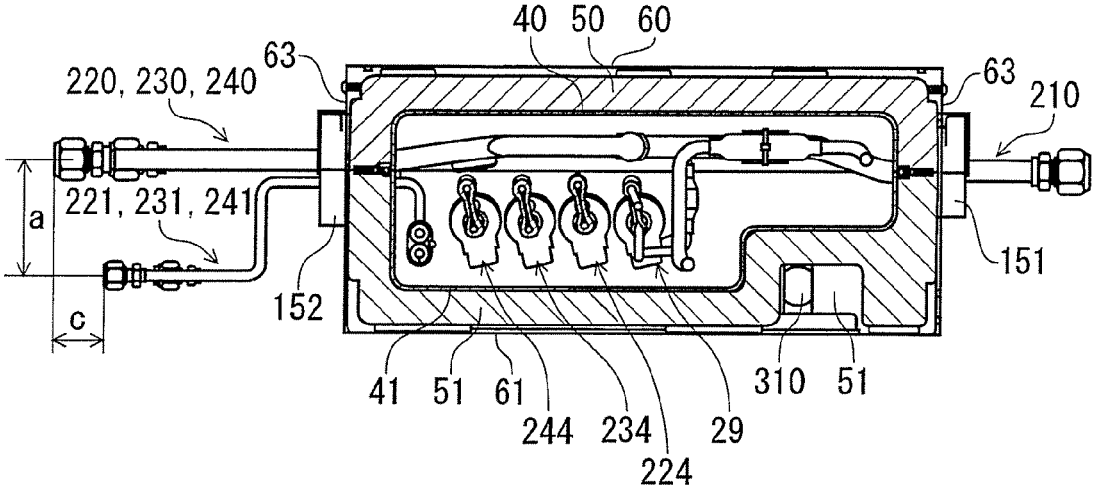
FIG. 4 is a section view showing the refrigerant distribution unit.

The pipe unit 2 shown in FIGS. 2 to 4 includes a refrigerant pipe 21 to be connected to the outdoor-unit-side pipe 110, a distribution portion 25 to be stored into the main unit 150, and branch refrigerant pipes 22, 23 and 24 respectively to be connected to their associated indoor-unit-side pipes 120, 130 and 140.

The refrigerant pipe 21 includes a gas pipe 210 and a liquid pipe 211. The gas pipe 210 includes a gas pipe joint 212 in the vicinity of the refrigerant distribution unit 15, while the liquid pipe 211 includes a liquid pipe joint 213 in the vicinity of the refrigerant distribution unit 15. Due to provision of the gas pipe joint 212 and the liquid pipe joint 213, the gas pipe 210 and the liquid pipe 211 can be connected to and removed from the outdoor-unit-side pipe 110.

The gas pipe 210 and the liquid pipe 211 are arranged horizontally and are spaced 40 mm or more from each other, while the gas pipe 210 and the liquid pipe 211 can be stored into the main unit 150 from a refrigerant pipe receiving portion 151.

The branch refrigerant pipes 22, 23 and 24 include branch gas pipes 220, 230, 240 and branch liquid pipes 221, 231, 241, respectively. The branch gas pipes 220, 230, 240 include branch gas pipe joints 222, 232, 242 in the vicinity of the refrigerant distribution unit 15, respectively; and the branch liquid pipes 221, 231, 241 include branch liquid pipe joints 223, 233, 243 in the vicinity of the refrigerant distribution unit 15, respectively. Due to provision of the branch gas pipe joints 222, 232, 242 and the branch liquid pipe joints 223, 233, 243, the branch refrigerant pipes 22, 23 and 24 can be connected to and removed from the indoor-unit-side pipes 120, 130 and 140, respectively.

The branch gas pipes 220, 230, 240 are respectively formed to have a linear shape. The branch liquid pipes 221, 231, 241 are respectively disposed downwardly of and spaced a given distance (a reference sign "a" shown in FIGS. 4 and 12) from the branch gas pipes 220, 230, 240, and are bent upwardly on the near side of the main unit 150; after then, the pipes are respectively bundled together by their associated rubber bushes 26 such that the branch gas pipe 220 and branch liquid pipe 221 are formed into a unified body, the branch gas pipe 230 and branch liquid pipe 231 are formed into a unified body, and the branch gas pipe 240 and branch liquid, pipe 241 are formed into a unified body. Also, the branch refrigerant pipes 22, 23 and 24 are arranged horizontally and are spaced 40 mm or more (a reference sign "b" shown in FIG. 12) from each other, while the branch refrigerant pipes 22, 23 and 24 can be stored into the main unit 150 from a branch refrigerant pipe receiving portion 152.

Also, between the branch gas pipe joint 222 and the branch liquid pipe joint 223, between the branch gas pipe joint 232 and branch liquid pipe joint 233, and, between the branch gas pipe joint 242 and branch liquid pipe joint 243, there is set a given distance (a reference sign "c" shown in FIGS. 4 and 12), whereby the joints are disposed such that the joints are not overlapped with each other.

<Distribution Portion>

Figure 5:
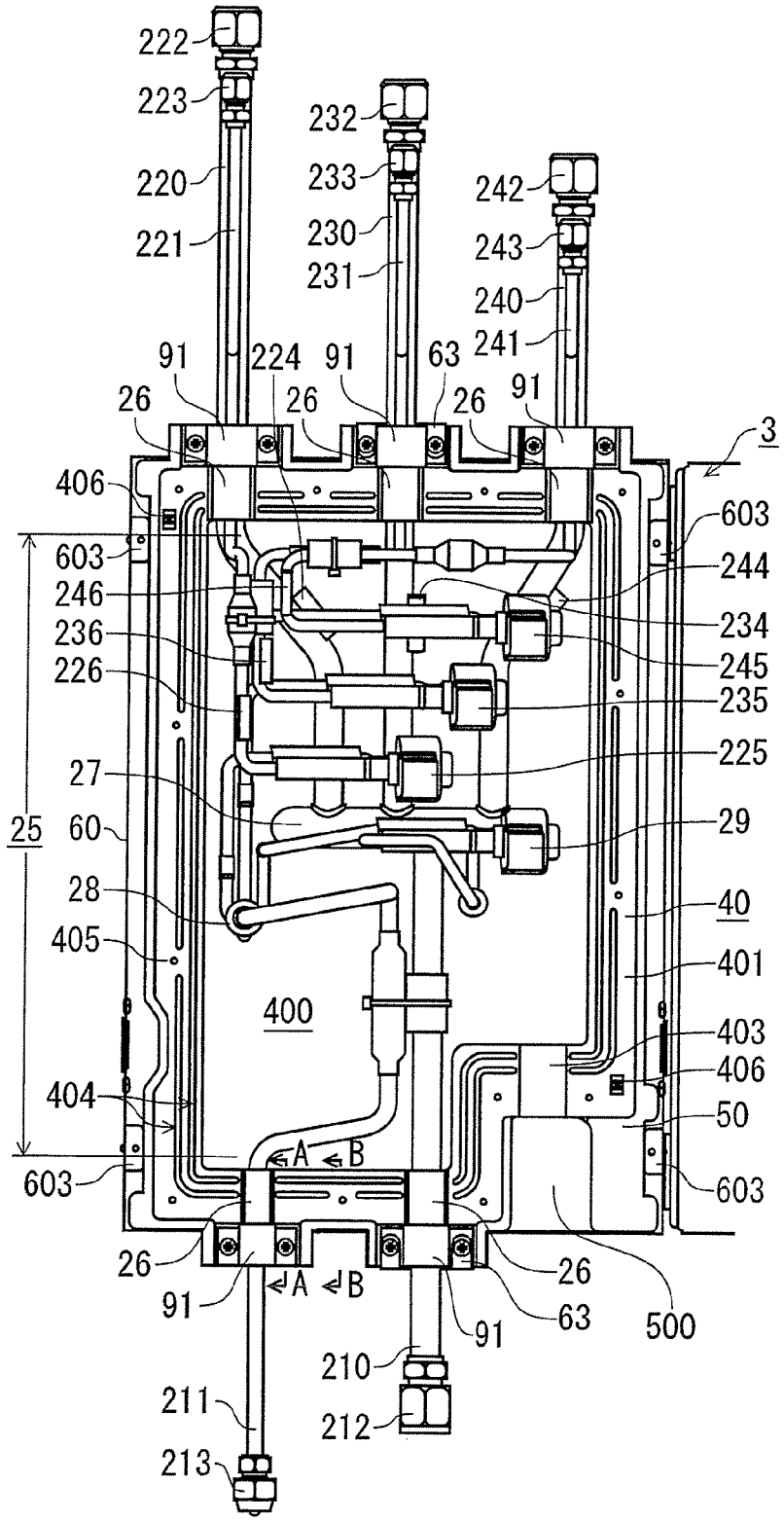
FIG. 5 is an internal structure view showing the refrigerant distribution unit.

FIG. 5 is a structure view showing the internal portion of the refrigerant distribution unit 15, showing a state in which the lower parts (which will be discussed later) of the main unit 150 are removed therefrom. The distribution portion 25 of the pipe unit 2 includes: a branch pipe 27 which makes the gas pipe 210 branch to the branch gas pipes 220, 230 and 240; branch gas pipe temperature sensors 224, 234 and 244 provided on the branch gas pipes 220, 230 and 240 respectively; a shunt 28 for diverging the refrigerant of the liquid pipe 211 to the branch liquid pipes 221, 231 and 241; electronic expansion valves 225, 235 and 245 respectively for adjusting amounts of the refrigerants flowing through their associated branch liquid pipes 221, 231 and 241; branch liquid pipe temperature sensors 226, 236 and 246 which are disposed nearer to the indoor units 12, 13 and 14 than the electronic expansion valves 225, 235 and 245 respectively; and, an on-off valve 29 for bypassing the refrigerant from the branch pipe 27 to the shunt 28.

To the branch gas pipe temperature sensors 224, 234 and 244 and the branch liquid pipe temperature sensors 226, 236 and 246, there are connected signal lines which are used to transmit the detected results of the sensors to the control substrate 30 of the electric component box 3. To the electronic expansion valves 225, 235 and 245 as well as to the on-off valve 29, there are connected wires which are used to drive the valves respectively. The signal lines and the wires are bundled together to provide a cable 80, while the cable 80 is connected to the control substrate 30 of the electric component box 3.

<Main Unit>

The main unit 150 shown in FIG. 3 is structured such that the pipe unit 2 can be held or covered by a seal case 4, an insulator case 5 and a case 6 which are arranged sequentially in this order from inside.

<Seal Case>

The seal case 4 is formed of synthetic resin and includes an upper seal case 40 and a lower seal case 41 which are divided vertically along the centers of pipe diameters of the horizontally extending refrigerant pipe 21 and the branch refrigerant pipes 22, 23 and 24.

The upper seal case 40 shown in FIGS. 3 and 5 includes a storage portion 400 for storing therein the branch portion 25 of the pipe unit 2, and an edge portion 401 formed on a periphery of the storage portion 400 for keeping seal property of the upper seal case 40.

In the edge portion 401, specifically, from the refrigerant pipe receiving portion 151 for receiving the refrigerant pipe 21 and also from the branch refrigerant pipe receiving portion 152 for receiving the branch refrigerant pipes 22, 23, 24, there are extended pipe mounting portions 402 which respectively draw such a semi-circular shape as to fit the pipes. On the right and left end portions of the pipe mounting portion 402, there are erected anchors 405 onto which screws (which will be discussed later) are mounted.

Also, a cable draw-out portion 403, which is used to draw out the cable (not shown), is also formed to have a semi-circular shape. Further, in the edge portion 401, there are provided projecting ribs 404 which extend in two lines in such a manner as to surround the storage portion 400. Insulating seals 44 are bonded on the projecting ribs 404, respectively (see FIG. 8).

Of the two-lined projecting ribs 404, the projecting rib 404 disposed outside includes the anchors 405 which are respectively erected and are spaced from each other for receiving screws (which will be discussed later). The anchors 405 are further provided erectly on four corners of the edge portion 401 as well.

The lower seal case 41 shown in FIG. 3 includes a storage portion 410 for storing therein the distribution portion 25 of the pipe unit 2, and an edge portion 411 which is formed on a periphery of the storage portion 410 and is used to keep sealing property of the lower seal case 41.

In the edge portion 411, specifically, in such portions of the edge portion 411 as are to be contacted with the refrigerant pipe 21 and the branch refrigerant pipes 22, 23, 24, there are formed pipe mounting portions 412 which respectively have a semi-circular shape; and also, there are formed cable draw-out portions 413 which respectively have a semi-circular shape and are used to draw out the cable 80. Also, in the edge portion 411, there are formed recessed ribs 412 which are used to receive the projecting ribs 404, respectively. Further, there are formed screw holes 415 which can be screwed with their associated anchors 405.

<Insulator Case>

The insulator case 5 is formed of highly heat-resisting styrene foam and has a constant thickness over the entire area thereof in order to enhance its heat-resisting property.

Referring to the structure of the insulator case 5 shown in FIG. 3, such portions thereof as correspond to the refrigerant pipe receiving portion 151 and branch refrigerant pipe receiving portion 152 are respectively projected out in a cylindrical manner; and, the insulator case 5 is divided into an upper insulator case 50 and a lower insulator case 51 along the centers of the pipe diameters of the refrigerant pipe 21 and branch refrigerant pipes 22, 23 and 24.

The upper insulator case 50 is structured such that the shape of the inside thereof is formed to fit the outer shape of the upper seal case 40. Also, the upper insulator case 50 includes a cable draw-out recessed portion 500 the shape of which is formed to fit the cable draw-out portion 403 of the upper seal case 40. And, in the left side surface of the upper insulator case 50, when it is viewed from the outdoor unit side, there is formed a cable side surface recessed portion 501 which is used to introduce the drawn-out cable 80 into the electric component box 3.

In the case of the lower insulator case 51, the shape of the inside thereof is formed to fit the outer shape of the lower seal case 41. Also, the lower insulator case 51 includes a cable draw-out recessed portion 510 the shape of which is formed to fit the cable draw-out portion 413 of the lower seal case 41. And, in the left side surface of the lower insulator case 51, when it is viewed from the outdoor unit side, there is formed a cable side surface recessed portion 511 which is used to introduce the cable 80, after it is drawn out, into the electric component box 3. Further, in the bottom surface of the lower insulator case 51, there is formed a bottom surface recessed portion 512 for the cable. The cable bottom surface recessed portion 512 is formed to cross the bottom surface of the lower insulator case 51 in such a manner that the cable bottom surface recessed portion 512 can connect together a first draw-out slot 604 and a second draw-out slot 605 which are respectively formed in the lower case 51 and also which will be discussed later.

<Case>

The case 6, which constitutes a contour of the main unit 150, can be formed by bending a metal sheet. And, the case 6 includes an upper case 60 and a lower case 61.

The upper case 60 shown in FIG. 3 has a box-like shape. Specifically, the upper case 60 includes an outdoor-unit-side wall 60*a*, an indoor-unit-side wall 60*b* which is disposed opposed to the outdoor-unit-side wall 60*a*, a first wall 60*c* disposed on the left when the upper case 60 is viewed from the outdoor unit 11 side, a second wall 60*d* which is situated on the right and is disposed opposed to the first wall 60*c*, and a ceiling surface portion 60*e*.

The outdoor-unit-side wall 60*a* and indoor-unit-side wall 60*b* respectively include upper insulator receiving portions 600 which are formed by cutting out the walls 60*a* and 60*b* in a semi-circular shape to fit the cylindrical shape of the upper insulator case 50 and each of which has such a length as extends to the centers of the pipe diameters of the refrigerant pipe 21 and the branch refrigerant pipes 22, 23 and 24. And, in the right and left end portions of the walls 60*a* and 60*b*, there are formed screw holes into which there can be screwed with the ceiling hanging metal fittings 62 for hanging down the refrigerant branch unit 2 from the ceiling; and, in the central portions of the walls 60*a* and 60*b*, there are formed screw holes into which there can be screwed with pipe hanging metal fittings 63 (which will be discussed later).

The first wall 60*c* and the second wall 60*d* respectively have such a length as reaches the bottom surface of the main unit; and, The first wall 60*c* and the second wall 60*d* respectively include, at the four upper and lower portions of the right and left end portions thereof, electric component box securing holes 601 into which there can be engaged their associated electric component box securing pawls 320 (hereinafter described as securing pawls 320, which will be discussed later) to thereby mount the electric component box 3 onto the case 6. Downwardly of the positions of the electric component box securing holes 601 formed in the lower portions of the right and left ends portions, there are provided dowels 602 which can be removably secured to dowel holes 612 (which will be discussed later). Also, downwardly of the dowels 602, there are formed screw mounting portions 603 which are extended up to the bottom surface of the case 6.

Figure 6:
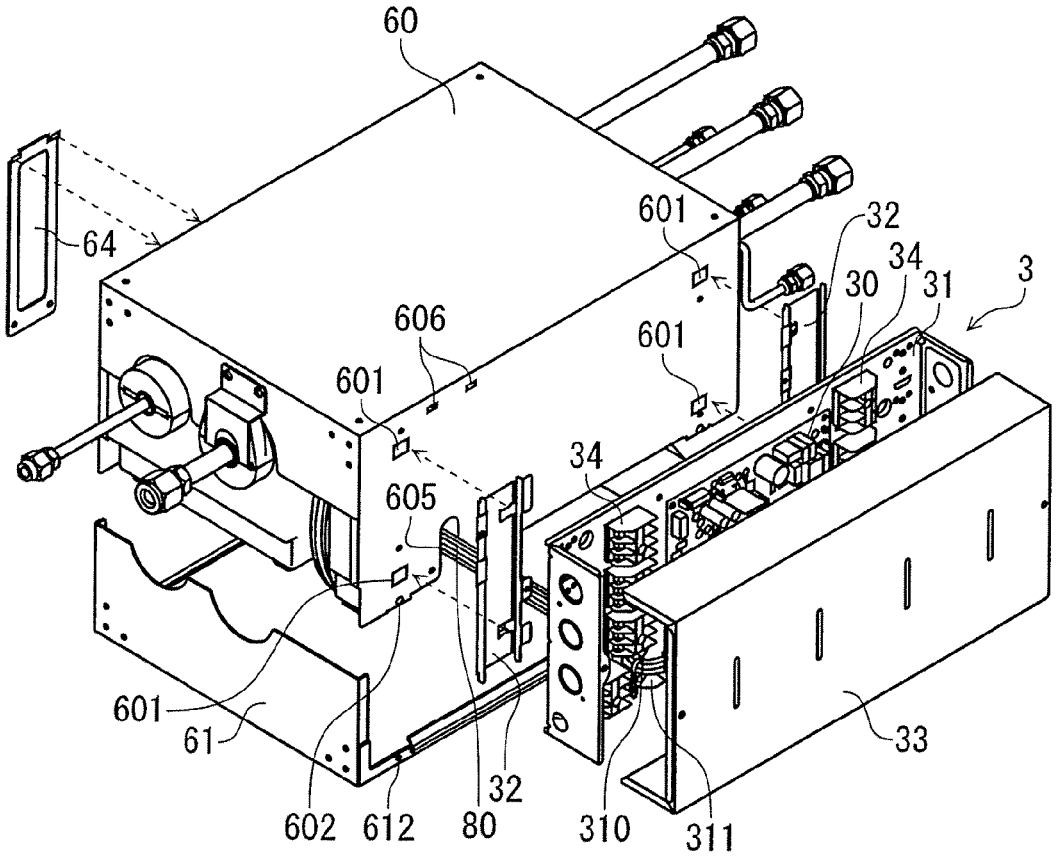
FIG. 6 is an exploded view showing a lower case and an electric component box included in the refrigerant distribution unit.

In the first wall 60*c*, there is formed a first cable draw-out slot 604 constituted of a cut-out groove which exists on the outdoor unit side and extends up to a vicinity of the ceiling surface of the case 6; and, in the second wall 60*d* shown in FIG. 6, there is formed a second cable draw-out slot 605 constituted of a cut-out groove which exists on the outdoor unit side and extends up to a middle portion of the wall 60*d*.

In such portions of the first and second walls 60*c* and 60*d* as exist near to the ceiling surface 60*e* and in the vicinity of the first and second cable draw-out slots 604 and 605, there are formed cable draw-out slot cover holes 606 to which cable draw-out slot covers 64 (which will be discussed later) can be secured.

The lower case 61 has a U-like shape and includes an outdoor-unit-side wall 61*a*, an indoor-unit-side wall 61*b*, and a bottom surface portion 61*e*.

The outdoor-unit-side wall 61*a* and indoor-unit-side wall 61*b* respectively include upper insulator receiving portions 610 which are formed by cutting out the respective portions 61*a* and 61*b* in a semi-circular shape to fit the cylindrical shape of the lower insulator case 51 and also which respectively have a length reaching the centers of the pipe diameters of the refrigerant pipe 21 and the branch refrigerant pipes 22, 23 and 24.

A metal plate, which is used to form the lower case 61, includes flange portions 611 which are formed by extending two end portions of the bottom surface portion 61*e*, bending the end portions, and spot welding the end portions to their associated outdoor-unit-side wall 61*a* and the indoor-unit-side wall 61*b*.

The flange portions 611 respectively include dowel holes 612 to which, when the lower case 61 is assembled, there can be removably secured their associated dowels 602. In such portions of the bottom surface portion 61*e* as exist near to the dowel holes 612, there are formed screw holes.

<Electric Component Box>

The electric component box 3 shown in FIGS. 3 and 6 includes a control substrate 30 for controlling the refrigerant distribution unit 15, an electric component box main body 31, two electric component box mounting plates 32 (hereinafter described as mounting plates 32), and an electric component box cover 33.

The electric component box main body 31 is constituted of a metal plate having a U-like shape; and, within the U-like shape, there are disposed the control plate 30 and multiple terminal bases 34. In a portion of the electric component box main body 31, there is formed a cable guide hole 310 which is used to guide the cable 80; and, in such inside portion of the electric component box main body 31 as exists near to the cable guide hole 310, there is provided a cable guide 311 which is used to connect the cable 80 to the electric component box main body 31 and guide the cable 80 to the control substrate 30.

The mounting plates 32 respectively have a rectangular shape, include electric component box securing pawls 320 (securing pawls 320) so formed in the two upper and lower portions thereof as to be bent inwardly symmetrically, and are welded to the two right and left portions of the outside of the electric component box main body 31.

<Assembling Method>

The refrigerant distribution unit 15 may be assembled in such a manner that, when compared with its installing state where it is hanged down from the ceiling, it is turned upside down. Specifically, firstly, the upper case 60 is placed with its ceiling surface portion 60*e* facing downward and then the upper insulator case 50 is superimposed on top of the inside of the upper case 60. The upper insulator case 50 is supported by the insulator receiving portion 600 of the upper case 60.

Figure 7:
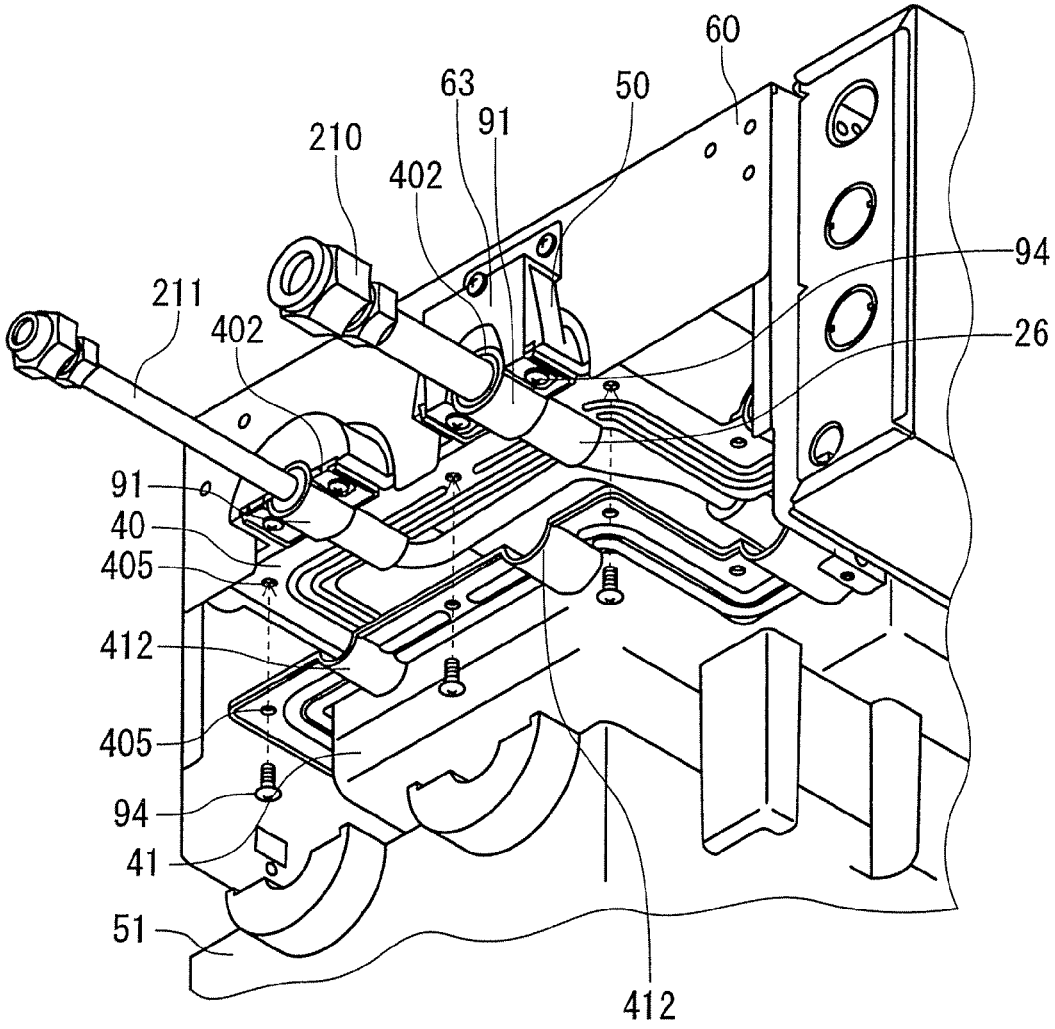
FIG. 7 is a detail view showing a refrigerant pipe receiving portion included in the refrigerant distribution unit.

Next, as shown in FIGS. 3, 5 and 7, the upper seal case 40 is fitted into the upper insulator case 50. And, such portions of the gas pipe 210, the liquid pipe 211 and the branch refrigerant pipes 22, 23, 24 of the pipe unit 2 as are wound by their associated rubber bushes 26 are fitted into the pipe mounting portions 402 of the upper case 40, and pipe holders 91 are fastened and fixed to the pipe mounting portions 402 from above the rubber bushes 26 using screws 94.

Figure 8:
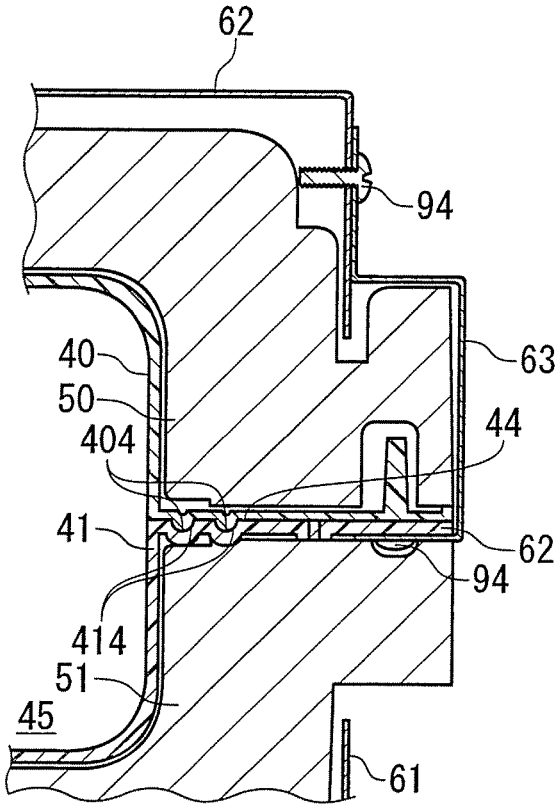
FIG. 8 is a section view showing the refrigerant distribution unit taken along the A-A line shown in FIG. 3.

Next, as shown in FIGS. 7 and 8, for the gas pipe 210 and the pipe mounting portion 402 of the branch refrigerant pipe 23, a pipe hanging metal fitting 63 with its upper end engaged with the upper case 60 is so provided as to extend over the upper insulator case 50 down to the lower end portion of the pipe holder 91. And, the pipe hanging metal fitting 63 and the pipe holder 91 are fastened together with the screws and are then fixed to the upper seal case 40.

The cables 80 are bundled together by a binding tool 82 and are drawn out to the outside from the cable receiving portion 403 of the upper seal case 40.

According to this structure, since the pipe unit 2 is fixed to the upper seal case 40 by the pipe hanging metal fitting 63, after the refrigerant distribution unit 15 is installed in such a manner that the refrigerant distribution unit 15 is hanged down from the ceiling, maintenance on the pipes, electronic expansion valves and the like disposed within the refrigerant distribution unit 15 can be carried out in the following manner. That is, simply by removing the lower case 61, lower insulator case 51 and lower seal case 41, the pipe unit 2 can be exposed to the outside, thereby being able to carry out maintenance on the pipe unit 2 without taking the refrigerant distribution unit 15 to pieces.

Figure 9:
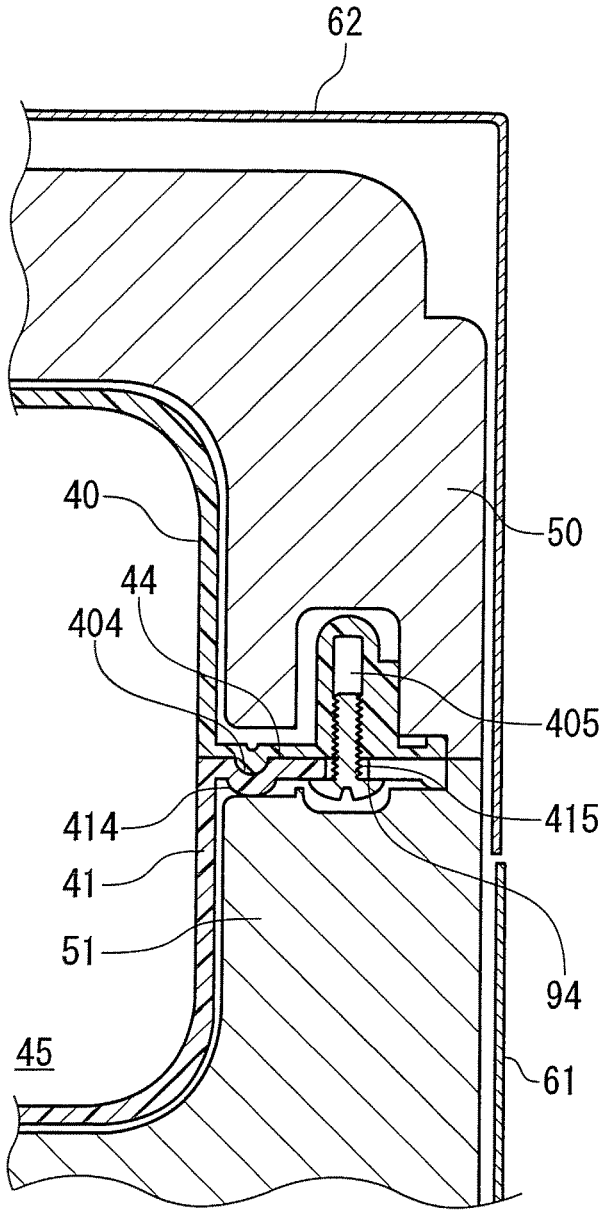
FIG. 9 is a section view showing the refrigerant distribution unit taken along the B-B line shown in FIG. 3.

Next, the seal case securing hole 416 of the lower seal case 41 is inserted in such a manner that the hole can be engaged with the seal case securing pawl 406 projected from the upper seal case 40. In the case that the upper and lower seal cases 40 and 41 are engaged with each other, as shown in FIG. 9, the recessed rib 414 of the lower seal case 41 is closely contacted with the projecting rib 404 of the upper seal case 40 through an insulating seal 44 with no clearance between the ribs 404 and 414. Next, the screws 94 are fastened through screw holes 415 with their associated anchors 405 which are respectively provided in the multiple portions of the edge portion 401.

As shown in FIG. 7, the pipe mounting portion 412 of the lower seal case 41 is structured such that the pipe mounting portion 412 can be fitted with the rubber bushes 26 of the gas pipe 210 and the liquid pipe 211 respectively stored in the upper seal case 40 but is prevented from covering the pipe mounting portion 402 of the upper seal case 40. Accordingly, the upper and lower seal cases 40 and 41 are superimposed on top of each other with no clearance between them, whereby the interior portion of the seal case can be kept hermetically sealed.

Owing to the hermetically sealed state of the interior portion of the seal case, the pipe unit 2 is prevented from touching the air, thereby being able to prevent drain water from being generated.

Next, the lower insulator case 51 is placed on top of the lower seal case 41. In this case, besides the lower insulator case 51, the screws 94, which have been engaged with the pipe holder 91 and pipe hanging metal fitting 63, are also covered with the lower insulator case 51. This can also prevent water or like from touching the screws 94.

Figure 10A:
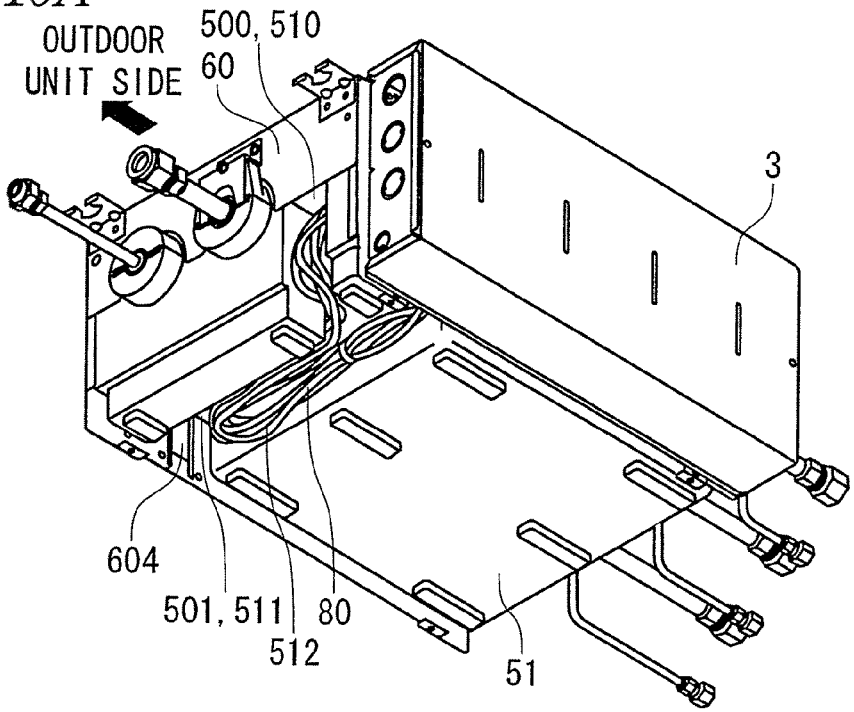
FIG. 10A is a view showing the electric component box when it is viewed from below.
Figure 10B:
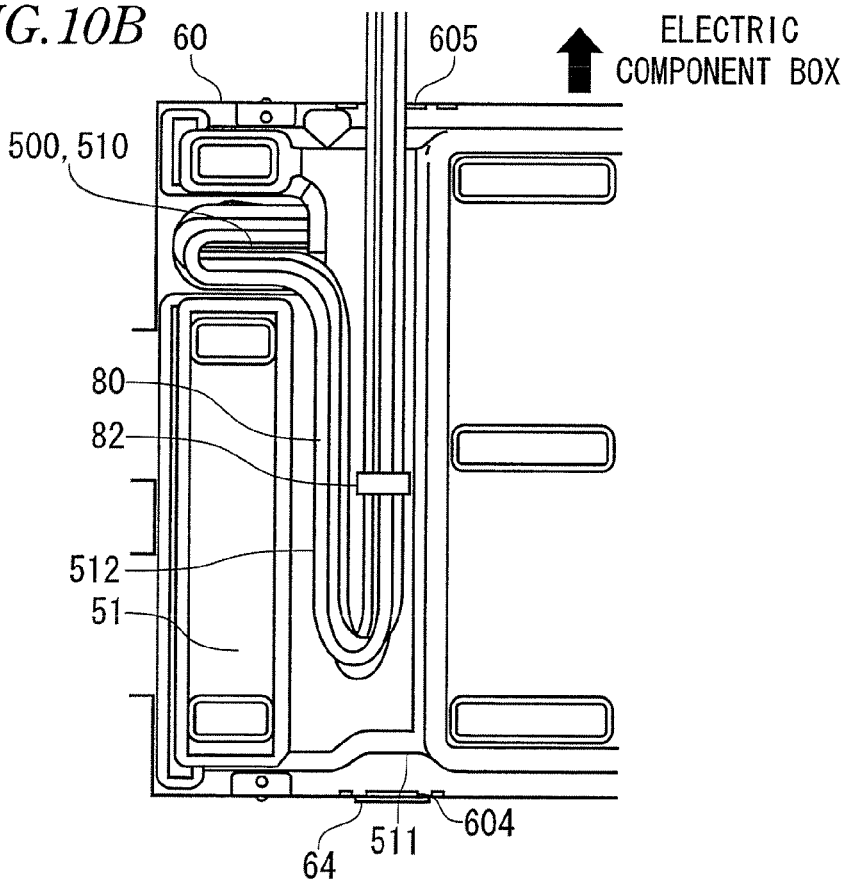
FIG. 10B is a bottom view thereof.

The electric component box 3 may be mounted onto any of the first and second walls 60*c* and 60*d* of the upper case 60. When mounting the electric component box 3 onto the second wall 60*d* which is the right lateral surface when viewed from the outdoor unit 11 side, as shown in FIGS. 10A and 10B, the cable 80 is guided along the draw-out recessed portion 500 of the upper insulator case and the draw-out recessed portion 510 of the lower insulator case to the cable bottom surface recessed portion 512. The cable 80, which has been guided to the cable bottom surface recessed portion 512, is turned back at the cable bottom surface recessed portion 512 and is drawn out from the second cable draw-out slot 605 to the outside of the main unit 150. The thus drawn-out cable 80, as shown in FIG. 6, is guided from the cable guide hole 310 of the electric component box main body 31 into the electric component box 3, is bundled to the electric component box main body 31 by the cable guide 311, and is then connected to multiple connectors (not shown) which are provided on the control substrate 30 of the electric component box 3. The electric component box main body 31, which has been connected to the cable 80, inserts the securing pawl 320 of the mounting plate 32 welded to the electric component box main body 31 into the electric component box securing hole 601 of the upper case 60. In this case, the securing pawl 320, specifically, the upper pawl thereof is held in a state where it is hanging down, whereby the electric component box 3 is provisionally fixed by the securing pawl 320. Next, the electric component box 3 is engaged from inside of the electric component box main body 31 into the upper case 60 using screws. As a result, the electric component box 3, which is provisionally fixed by the securing pawl 320, is fixed. Then, the electric component box cover 33 is placed on top of the electric component box 3.

Figure 11A:
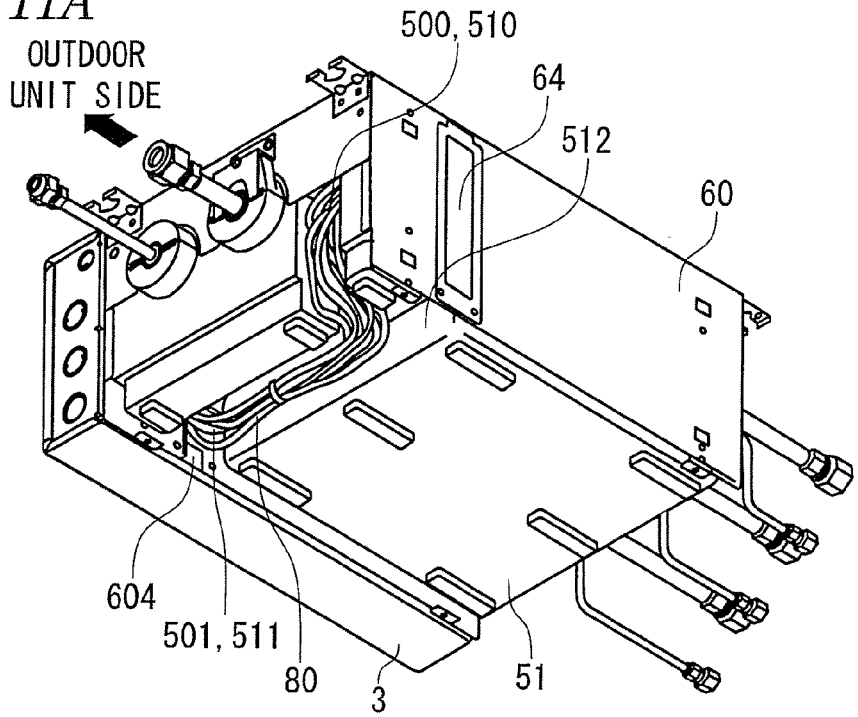
FIG. 11A is a view showing the electric component box when it is viewed from below.
Figure 11B:
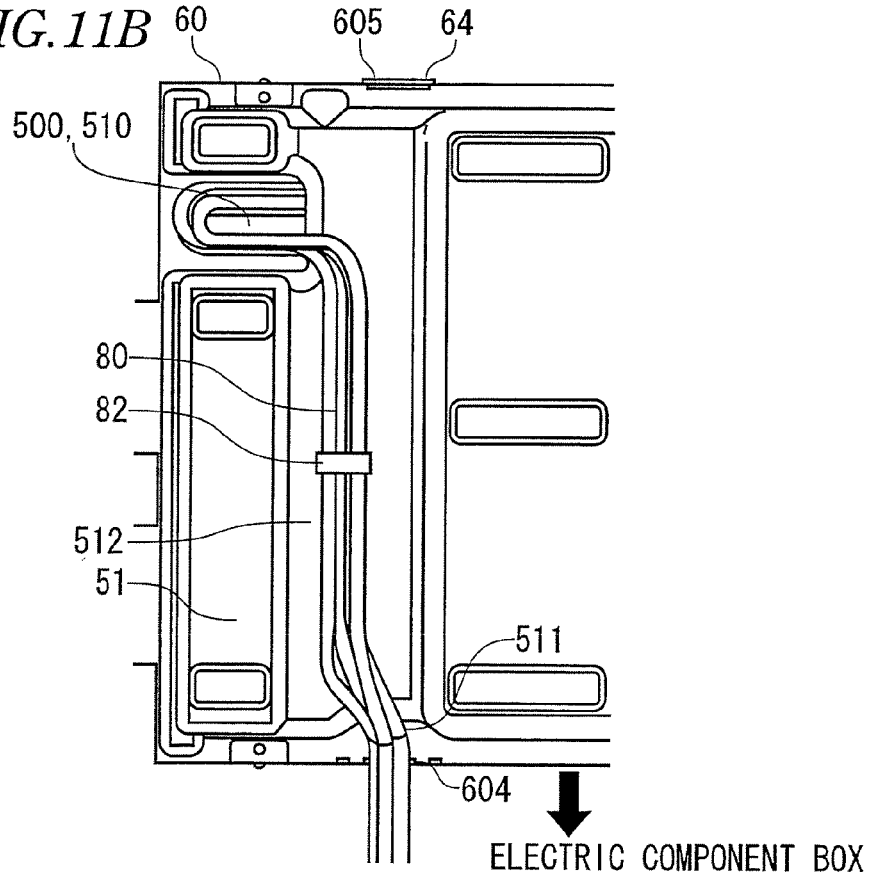
FIG. 11B is a bottom view thereof.

Also, as shown in FIGS. 11A and 11B, when mounting the electric component box 3 onto the first wall 60*c* which is situated on the left when the upper case 60 is viewed from the outdoor unit side, the electric component box main body 31 is turned upside down and the securing pawl 320 of the mounting plate 32 is inserted into the securing hole 601 of the upper case 6. Since the electric component box main body 31 is turned upside down, the cable guide hole 310 is moved to the ceiling side.

The cable 80, which has been guided to the cable bottom surface recessed portion 512, is moved over the cable bottom surface recessed portion 512, is moved along the cable side surface recessed portions 501, 511, is drawn out from above the first cable draw-out slot 604 to the outside of the main unit 150, and is guided from the cable guide hole 310 of the electric component box main body 31 into the electric component box 3.

According to this mounting method, for example, even when moving the electric component box 3 from one place to the other according to the site where the refrigerant distribution unit 15 is installed, the electric component box 3 can be moved simply with the cable 80 remaining connected.

Next, a cable draw-out slot cover 64 is mounted onto any one of the first cable draw-out slot 604 and the second cable draw-out slot 605 which are formed in the portion of the upper case 60 where the electric component box 3 is not installed. Since the cable draw-out slot cover 64 is formed longer than the cable draw-out slot 604, and also since cable draw-out cover holes 606 are formed at the symmetric positions of the first and second walls 60*c* and 60*d*, the cable draw-out slot cover 64 can be mounted onto any one of these surface portions. The upper pawls of the cable draw-out slot cover 64 are secured to the cable draw-out slot cover holes 606, and then the cable draw-out slot cover 64 is engaged with the upper case 60 using screws. This structure can hide the cable draw-out cover holes 606 from the outside. Therefore, an appearance of the upper case can be enhanced and also an invasion of dust into the inside of the upper case can be prevented.

Next, the lower case 61 is assembled to the upper case 60. In this case, the dowel 602 provided on the upper case 60 is secured to a dowel hole 612 formed in the lower case 61, thereby fixing the lower case 61 provisionally. Next, the screws 94 are engaged with the screw mounting portion 603 of the bottom surface 61*e* of the upper case 60 to thereby fix the upper case 60 and lower case 61 to each other.

When carrying out maintenance on the pipe unit 2, the screws 94 engaged with the screw mounting portion 603 are removed. In this case, even when the screws 94 are removed, the lower case 61 is fixed provisionally because of engagement of the dowel 602 into the dowel hole 612. Therefore, there is no fear that the lower case 61 can fall down unexpectedly.

Since the lower case 61 can be provisionally fixed to the upper case due to the engagement of the dowel hole 612 with the dowel 602, it is possible to provide a provisionally fixing function without using new parts.

<Vertical Installation>

Figure 12A:
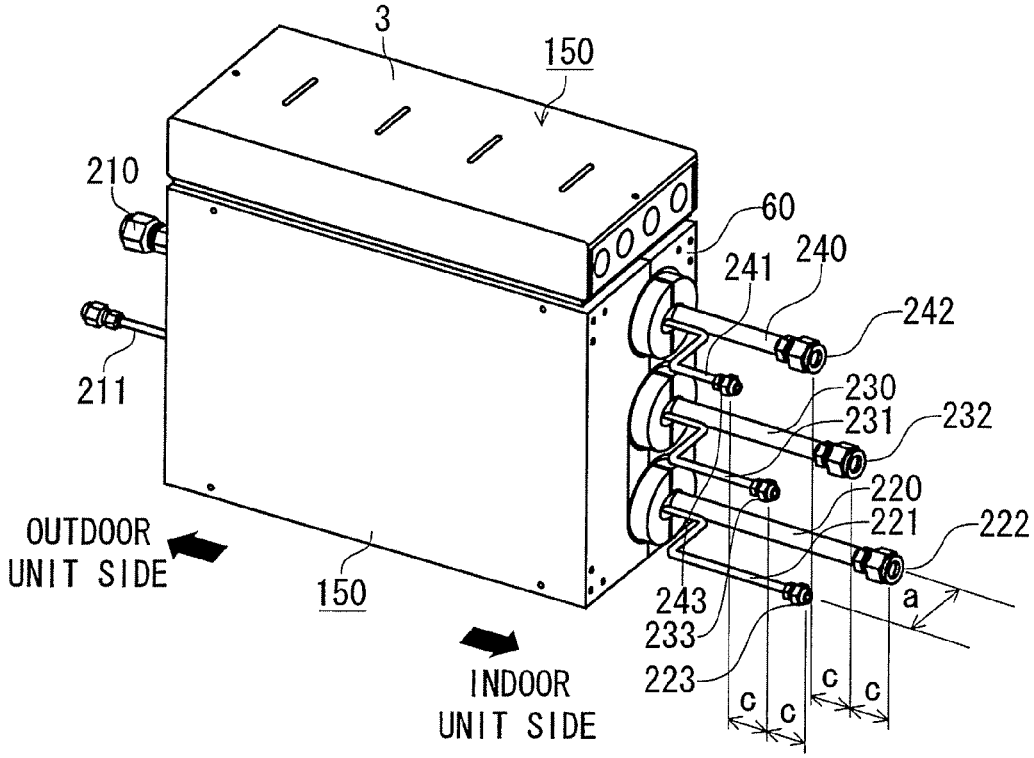
FIG. 12A is a perspective view thereof.
Figure 12B:
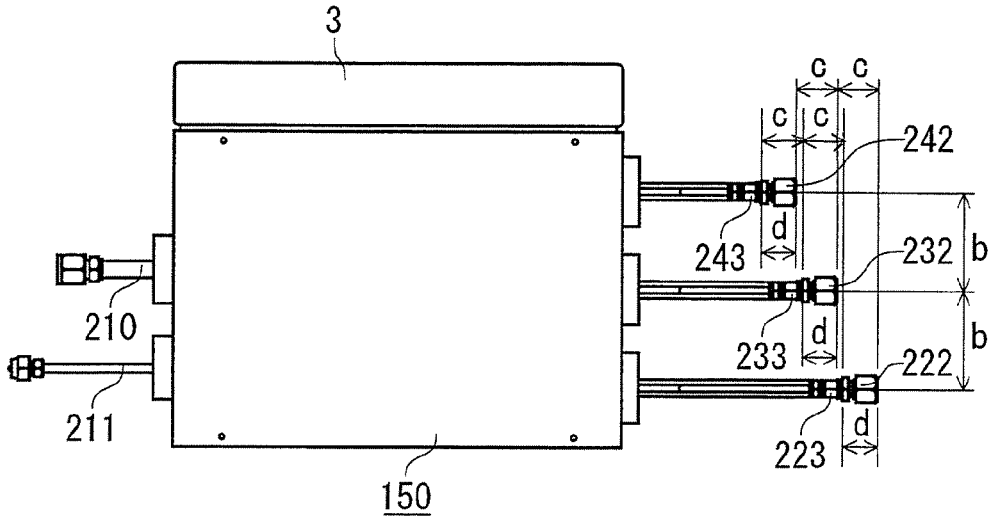
FIG. 12B is a front view thereof.

FIGS. 12A and 12B show a state in which the refrigerant distribution unit 15 is vertically installed. Also, in the case that the refrigerant distribution unit 15 is hanged down vertically from the ceiling, the refrigerant distribution unit 15 is turned upside down. In both cases, that is, in the vertical installation case and in the case that it is hanged down vertically from the ceiling, in maintenance, in most cases, the control substrate 30 of the electric component box 3 must be replaced or repaired. Therefore, it is necessary to install the electric component box 3 on the side that is near to an operator.

With respect to the electric component box 3, the branch gas pipes 220, 230 and 240 and the branch liquid pipes 221, 231 and 241 are installed parallel to each other in such a manner that their respective lengths (d) increase sequentially starting from one which is disposed nearest to the electric component box 3.

Also, the branch refrigerant pipes 22, 23 and 24 are disposed spaced by a given distance of 40 mm or more (b) from each other. The branch gas pipes 220, 230 and 240 are spaced by a given distance (a) from the branch liquid pipes 221, 231 and 241, respectively. Also, the branch gas pipe joints 222, 232 and 242 are spaced by a given distance (c) from their associated branch liquid pipe joints 223, 233 and 243, respectively, so that they are not overlapped with each other. Owing to this structure, when the branch gas pipe 220 and the branch liquid pipe 221 situated on the deepest side are firstly installed, the branch gas pipe 230 and the branch liquid pipe 231 are next installed, and the branch gas pipe 240 and the branch liquid pipe 241 are finally installed sequentially, a tool such as a spanner can be rotated without being interfered by the pipes situated on the near side as in the related-art technology. Thus, the installation operation can be carried out quickly.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A refrigerant distribution unit for an air conditioner, comprising:

a refrigerant pipe configured to be connected to an outdoor-unit-side pipe for an outdoor unit;

a plurality of indoor-unit-side pipes for indoor units;

a plurality of branch refrigerant pipes, wherein each of the plurality of branch refrigerant pipes includes a branch gas pipe and a branch liquid pipe;

wherein each branch refrigerant pipe is respectively configured to be connected to a corresponding indoor-unit-side pipe;

a distribution portion which distributes a refrigerant from the refrigerant pipe to the plurality of branch refrigerant pipes;

a main unit which stores the distribution portion and includes a first side face from which the refrigerant pipe extends and a second side face from which the branch gas pipes and the branch liquid pipes extend, the second side face being opposed to the first side face and forming a reference plane, a third side face adjacent to the first side face and the second side face from which the refrigerant pipe and the plurality of branch refrigerant pipes extend, and a fourth side face adjacent to the first side face and the second side face from which the refrigerant pipe and the plurality of branch refrigerant pipes extend, the third side face being opposed to the fourth side face;

an electric component box, the electric component box having a first sidewall and a second sidewall, wherein the first and second sidewalls are separated by a distance along the reference plane;

a cable connecting the electric component box to the main unit; and an insulator case provided within the main unit, the insulator case comprising a bottom surface and a first recessed portion formed in the bottom surface, wherein the electric component box is capable of being provided on either of the third side face or the fourth side face of the main unit, wherein each branch gas pipe has a first joint portion configured to connect the branch gas pipe to one of the plurality of indoor-unit-side pipes, wherein each branch liquid pipe has a second joint portion configured to connect the branch liquid pipe to one of the plurality of indoor-unit-side pipes, wherein the branch gas pipes and the branch liquid pipes extend from the second side face of the main unit in such a manner that the branch gas pipes and the branch liquid pipes are spaced from each other and are parallel to each other, wherein each first joint portion is disposed at a different distance than each of the other first joint portions from the reference plane, wherein each second joint portion is disposed at a different distance than each of the other second joint portions from the reference plane, wherein the branch gas pipes have different lengths and are disposed parallel and adjacent to each other sequentially from a shortest length to a longest length, wherein the branch liquid pipes have different lengths and are disposed parallel and adjacent to each other sequentially from a shortest length to a longest length, wherein the refrigerant pipe configured to be connected to the outdoor-unit-side pipe for an outdoor unit includes a gas pipe and a liquid pipe, wherein all of the portions of the gas pipe and the liquid pipe outside the main unit are linear and arranged parallel to each other with a constant distance therebetween, wherein the gas pipe and the liquid pipe of the refrigerant pipe are spaced from each other in a horizontal direction, wherein the branch gas pipe and the branch liquid pipe of each of the plurality of branch refrigerant pipes are spaced from each other in a vertical direction perpendicular to the horizontal direction, wherein the third side face of the main unit comprises a slot which extends from an edge of the third side face to a middle portion of the third side face, wherein the fourth side face of the main unit comprises a slot which extends from an edge of the fourth side face towards a middle portion of the fourth side face, wherein the electric component box further comprises a hole, wherein the slot of the third side face of the main unit, the slot of the fourth side face of the main unit, and the hole of the electric component box are configured to receive the cable, wherein the first recessed portion extends along the bottom surface of the insulator case from the slot in the third side face of the main unit to the slot in the fourth side face of the main unit.

2. The refrigerant distribution unit according to claim 1, wherein, in each branch refrigerant pipe, the entire branch gas pipe is linearly parallel to a portion of the branch liquid pipe.

3. The refrigerant distribution unit according to claim 2, wherein the first joint portion is located on a portion of the branch gas pipe that extends linearly from the second side face of the main unit and parallel to the branch liquid pipe.

4. The refrigerant distribution unit according to claim 3, wherein the second joint portion is located on a portion of the branch liquid pipe that extends linearly from the second side face of the main unit and parallel to the branch gas pipe.

5. The refrigerant distribution unit according to claim 4, wherein the first joint portion is located on an end of the branch gas pipe, wherein the second joint portion is located on an end of the branch liquid pipe.

6. The refrigerant distribution unit according to claim 1, wherein each second joint portion is disposed at a different distance than each corresponding first joint portion of the respective branch refrigerant pipe from the reference plane formed by the second side face of the main unit.

7. The refrigerant distribution unit according to claim 1, wherein the main unit has a first receiving portion and a second receiving portion, wherein the gas pipe extends through the first receiving portion, and the liquid pipe extends through the second receiving portion.

8. The refrigerant distribution unit according to claim 7, wherein the first receiving portion and the second receiving portion of the main unit are separate from each other.

9. The refrigerant distribution unit according to claim 7, wherein the gas pipe and the liquid pipe are different lengths.

10. The refrigerant distribution unit according to claim 1, wherein the electric component box is configured to be moved from being provided at one of the third side face or the fourth side face to being provided at the other of the third side face or the fourth side face while the cable remains connected to the electric component box and the main unit.

11. The refrigerant distribution unit according to claim 1, wherein the cable is capable of being drawn through the first recessed portion formed in the bottom surface of the insulator case to the third side face or the fourth side face of the main unit, through the slot of either of the third side face or the fourth side face of the main unit, and through the hole of the electric component box.

12. The refrigerant distribution unit according to claim 1, further comprising a seal case provided within the insulator case, the seal case having an opening for receiving the cable;

the insulator case further comprising a second recessed portion formed in the insulator case, wherein the second recessed portion extends from the first recessed portion to the opening for receiving the cable in the seal case.

13. The refrigerant distribution unit according to claim 12, wherein the cable is capable of being drawn from the opening for receiving the cable in the seal case, through the second recessed portion formed in the insulator case, through the first recessed portion formed in the bottom surface of the insulator case to the third side face or the fourth side face of the main unit, through the slot of either of the third side face or the fourth side face of the main unit, and through the hole of the electric component box.

14. The refrigerant distribution unit according to claim 13, wherein the distribution portion is provided within the seal case.

15. The refrigerant distribution unit according to claim 1, wherein either one of the slot of the third side face of the main unit or the slot of the fourth side face of the main unit receives the cable.

* * * * *